US009088104B2

(12) United States Patent
Kahara et al.

(10) Patent No.: US 9,088,104 B2
(45) Date of Patent: Jul. 21, 2015

(54) LOCK DEVICE

(71) Applicant: KABUSHIKI KAISHA TOKAI RIKA DENKI SEISAKUSHO, Aichi (JP)

(72) Inventors: Keiji Kahara, Aichi (JP); Toshiharu Katagiri, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 92 days.

(21) Appl. No.: 14/096,376

(22) Filed: Dec. 4, 2013

(65) Prior Publication Data

US 2014/0170889 A1 Jun. 19, 2014

(30) Foreign Application Priority Data

Dec. 13, 2012 (JP) ..... 2012-272497

(51) Int. Cl.
*H01R 13/62* (2006.01)
*H01R 13/639* (2006.01)
*H01R 13/627* (2006.01)

(52) U.S. Cl.
CPC ..... *H01R 13/6397* (2013.01); *H01R 13/6275* (2013.01); *H01R 2201/26* (2013.01)

(58) Field of Classification Search
CPC ..... H01R 13/6397
USPC ..... 439/133, 142, 304, 352
See application file for complete search history.

(56) References Cited

U.S. PATENT DOCUMENTS 8,016,604 B2 * 9/2011 Matsumoto et al. ..... 439/304
8,075,329 B1 * 12/2011 Janarthanam et al. ..... 439/304
8,206,172 B2 * 6/2012 Katagiri et al. ..... 439/352
8,311,690 B2 * 11/2012 Tanaka ..... 701/22
8,317,534 B2 * 11/2012 Osawa et al. ..... 439/353
8,357,001 B2 * 1/2013 Katagiri et al. ..... 439/304
8,357,002 B2 * 1/2013 Katagiri et al. ..... 439/304
8,454,375 B2 * 6/2013 Bauer ..... 439/135
8,602,804 B2 * 12/2013 Kurumizawa et al. ..... 439/304
8,698,349 B2 * 4/2014 Kurumizawa et al. ..... 307/10.1
8,712,648 B2 * 4/2014 Charnesky ..... 701/49
8,823,486 B2 * 9/2014 Jung et al. ..... 340/5.6
8,944,477 B2 * 2/2015 Proefke et al. ..... 292/144
2008/0185991 A1 * 8/2008 Harris et al. ..... 320/109
2010/0228405 A1 * 9/2010 Morgal et al. ..... 701/2

FOREIGN PATENT DOCUMENTS

JP 2009-081917 4/2009

* cited by examiner

*Primary Examiner* — Neil Abrams

(74) *Attorney, Agent, or Firm* — Greenblum & Bernstein, P.L.C.

(57) ABSTRACT

A lock device includes a lock member moved between a lock position, at which the lock member restricts removal of a locking subject from a power port, and an unlock position, at which the lock member permits removal of the locking subject from the power port. A transmission member is moved between a first position, at which the transmission member fixes the lock member at the lock position, and a second position, at which the transmission member permits movement of the lock member to the unlock position. A auxiliary unlocking mechanism includes a movable forcible unlocking member, which manually moves the transmission member to the second position, and a holding unit, which holds the forcible unlocking member while permitting such movement. The auxiliary unlocking mechanism may be used should there be failure of the main unlocking mechanism.

7 Claims, 11 Drawing Sheets

LOCK DEVICE

CROSS-REFERENCE TO RELATED APPLICATIONS

This application is based upon and claims the benefit of priority from prior Japanese Patent Application No. 2012-272497, filed on Dec. 13, 2012, the entire contents of which are incorporated herein by reference.

BACKGROUND OF THE INVENTION

The present invention relates to a lock device for locking and unlocking a locking subject related to a power port.

Vehicles that emit less carbon dioxide, such as plugin hybrid vehicles and electric vehicles, are environment-friendly and have become popular. Such a vehicle is powered by a battery. When the battery drains after driving the vehicle over a long distance, the battery is recharged. Thus, the body of the vehicle is provided with a power port that is used to charge the battery. A charge cable of a charging facility is connected to the power port to supply power from the charging facility and charge the battery. The battery charging takes a long time. Thus, a charge cable lock device may be used to lock the charge cable to the vehicle body and prevent theft of the charge cable. Japanese Laid-Open Patent Publication No. 2009-081917 describes an example of such a charge cable lock device.

A motor-driven lock device is one type of such a lock device. For example, the motor-driven lock device includes an actuator that moves a transmission member, such as a lock stopper, in a lock direction or unlock direction so that a lock pin is selectively engaged with and disengaged from a charge cable. However, if the actuator fails to function when the lock pin is in a lock state, the motor-driven lock device cannot move the lock stopper in the unlock direction to unlock the charge cable.

SUMMARY OF THE INVENTION

One aspect of the present invention is a lock device including a lock member moved between a lock position, at which the lock member restricts removal of a locking subject from a power port, and an unlock position, at which the lock member permits removal of the locking subject from the power port. A transmission member is moved between a first position, at which the transmission member fixes the lock member at the lock position, and a second position, at which the transmission member permits movement of the lock member to the unlock position. A forcible unlocking mechanism includes a movable forcible unlocking member, which manually moves the transmission member to the second position, and a holding unit, which holds the forcible unlocking member while permitting movement of the transmission member between the first position and the second position.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

A lock device according to one embodiment of the present invention will now be described with reference to FIGS. 1 to 11.

Outline of Charge System

Figure 1:
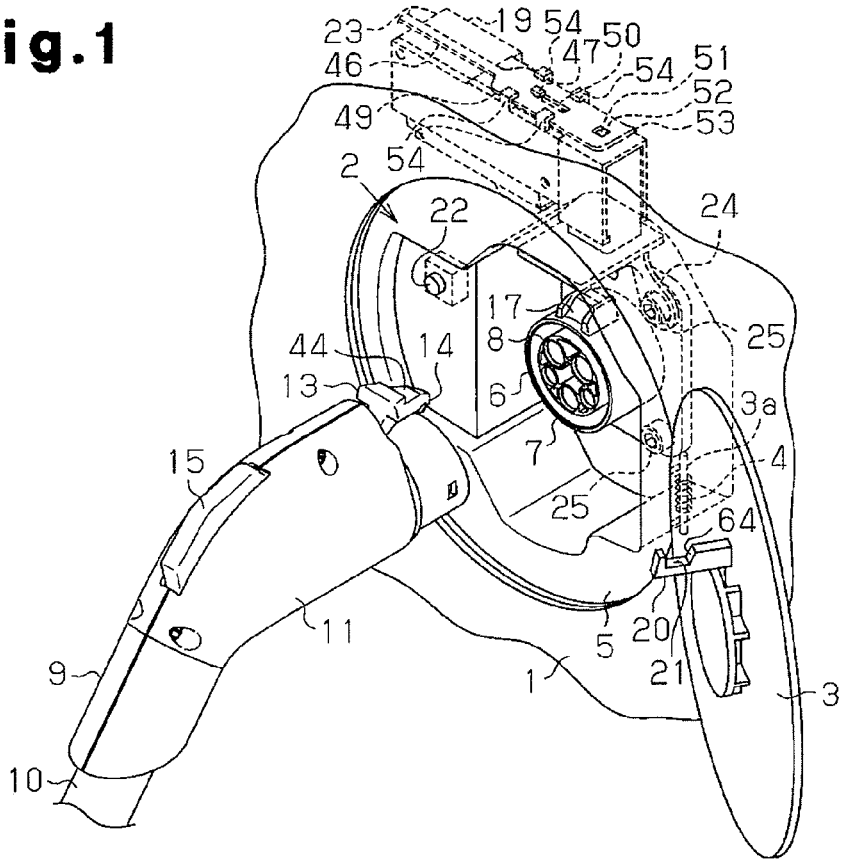
FIG. 1 is a perspective view showing a power port in one embodiment.

Referring to FIG. 1, a vehicle such as a plugin hybrid vehicle includes a charge system that allows for a battery (not shown) of the vehicle to be charged by an external power supply installed in a household, charging station, or the like. The body 1 of the vehicle has a side wall including a power port 2. A lid 3 opens and closes the power port 2. The lid 3 is pivotal about a shaft 3*a*, which extends in the vertical direction. An urging member 4, such as a torsion spring, is arranged on the shaft 3*a* to urge the lid to an open position. An inlet 6, which serves as a power receiving connector, is arranged at the middle of a lid box 5 in the power port 2. The inlet 6 includes a cylindrical inlet case 7, a terminal unit 8 arranged in the inlet case 7, and a catch 17 arranged on the inlet case 7. The lid 3 corresponds to a locking subject.

Figure 2:
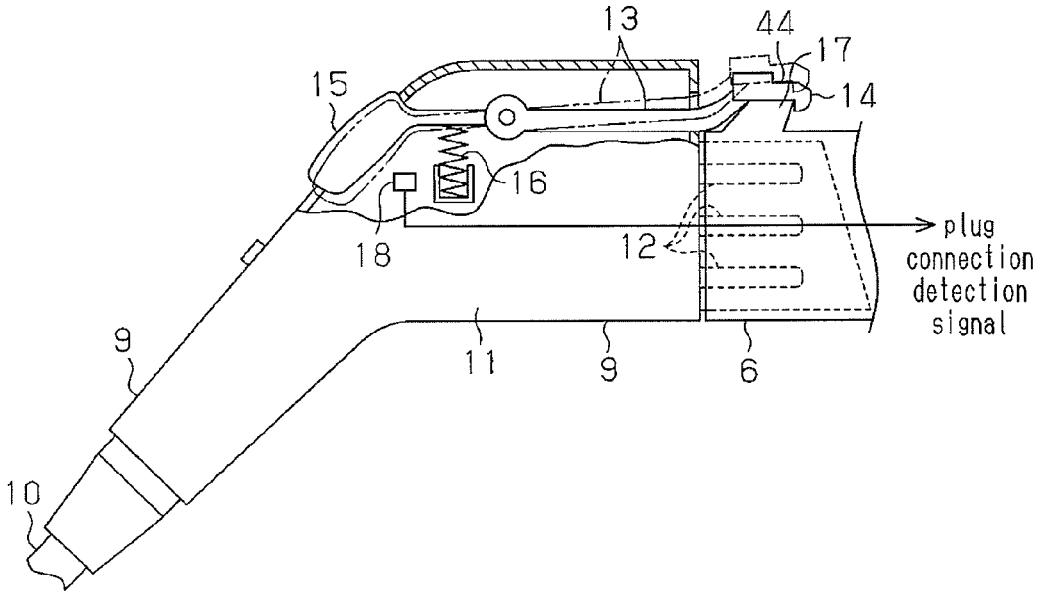
FIG. 2 is a diagram showing a charge cable connected to an inlet.

Referring to FIG. 2, a charge cable 9 extending from an external power supply is connectable to the inlet 6. The charge cable 9 includes a cable portion 10 and a power plug 11, which is arranged on the distal end of the cable portion 10. A terminal unit 12 is arranged on the distal end of the power plug 11 in correspondence with the terminal unit 8 of the inlet 6. A lock arm 13 is pivotally coupled to the power plug 11 to hold the power plug 11 on the inlet 6. The lock arm 13 includes a hook 14, which is arranged on the distal end of the lock arm 13, and an arm operation portion 15, which is arranged on the basal end of the lock arm 13. The hook 14 and the arm operation portion 15 are exposed to the exterior. An urging member 16 is arranged on the lock arm 13 near the arm operation portion 15 to constantly urge the lock arm 13 to a close position. The charge cable 9 corresponds to a locking subject.

When the power plug 11 is connected to the inlet 6, the power plug 11 is fitted straight to the inlet 6. The hook 14 comes into contact with a sloped surface of the catch 17 on the inlet case 7. This lifts the hook 14 against the urging force of the urging member 16. After the hook 14 moves over the sloped surface, the power plug 11 is fully fitted to the inlet 6. Then, the urging force of the urging member 16 pivots the lock arm 13 to the close position. This hooks the hook 14 to the catch 17 so that the power plug 11 is held by the inlet 6.

A plug connection detector 18 is arranged in the power plug 11 to detect connection of the charge cable 9 to the inlet 6. When the charge cable 9 is connected to the inlet 6 and the hook 14 is hooked to the catch 17, the lock arm 13 is arranged at the close position. Thus, the plug connection detector 18 detects that the lock arm 13 is located at the close position and provides a plug connection detection signal, which indicates that the power plug 11 is connected to the inlet 6, to the vehicle body 1 via the terminal units 8 and 12.

Structure of Lock Device

As shown in FIG. 1, the power port 2 includes a lock device 19 capable of locking both of the lid 3 and the charge cable 9. In other words, the lock device 19 of the present example is of an integrated type in which the locking of the lid 3 and the locking of the charge cable 9 are performed with the same actuator. A striker 20 projects from a rear surface of the lid 3. The lock device 19 engages the striker 20 when locking the lid 3. An engagement groove 21 having a predetermined depth is formed in the distal end of the striker 20. A trigger switch 22 is arranged in the power port 2. The trigger switch 22 may be of a push type. The trigger switch 22 is capable of detecting, for example, the opening and closing of the lid 3 or further inward pushing of the lid 3 from a closed position.

Figure 3:
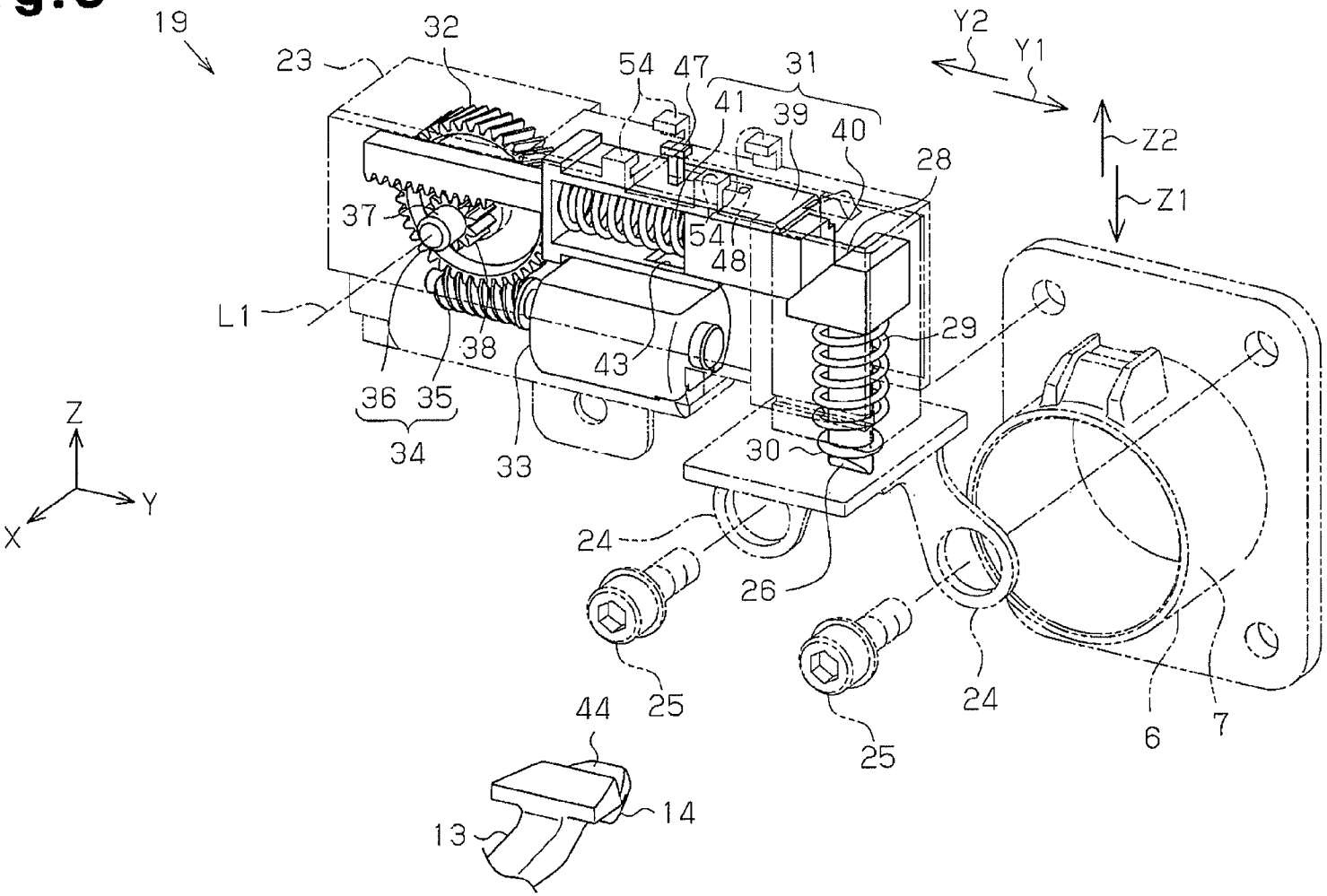
FIG. 3 is a perspective view showing the structure of a lock device.

Referring to FIG. 3, the lock device 19 includes a housing 23. Two tabs 24, which are coupled to the lid box 5, extend from the lower end of the housing 23. A fastener 25 (e.g., bolt) fastens each tab 24 of the housing 23 to the lid box 5 together with the inlet case 7 to couple the housing 23 to the lid box 5. For example, the inlet case 7 includes four coupling portions arranged around the inlet 6. The two tabs 24 of the housing 23 and the two coupling portions of the inlet 6 located near the catch 17 are fastened together to the lid box 5.

The housing 23 of the lock device 19 accommodates a lock pin 26, which is engageable with the lid 3 or the power plug 11. The lock pin 26 is movable back and forth in its longitudinal direction (Z axis direction in FIG. 3). A bottom wall of the housing 23 includes a receptacle 27 (refer to FIGS. 4A and 6A). The lock pin 26 is fitted into the receptacle 27 in a movable manner. When the lock pin 26 moves in a lock direction (direction of arrow Z1 in FIG. 3), the lock pin 26 extends out of the opening of the receptacle 27. When the lock pin 26 moves in the unlock direction (direction of arrow Z2 in FIG. 3), the lock pin 26 is concealed in the receptacle 27. The lock pin 26 corresponds to a lock member.

An upper portion of the lock pin 26 includes a pushing slope 28 that functions as a pushing surface when moving the lock pin 26 in the lock direction (direction of arrow Z1 in FIG. 3). An urging member 29 is arranged on the lock pin 26 to constantly urge the lock pin 26 in the unlock direction (direction of arrow Z2 in FIG. 3). The urging member 29 may be a coil spring. A seal 30 is fixed on the lock pin 26 so that the gap between the receptacle 27 and the lock pin 26 is impervious to water. The seal 30 is received in a groove extending around the lock pin 26. The seal 30 may be an O-ring.

A link 31 and a rotation member 32 connect the lock pin 26 to a lock motor 33. A worm gear 34 couples a motor shaft of the lock motor 33 to the rotation member 32. The worm gear 34 includes a worm 35, which is arranged on the motor shaft, and a worm wheel 36 formed by the rotation member 32. The link 31 functions as a transmission member.

A shaft 37 extends from the rotation member 32. A pinion 38, which rotates coaxially with the rotation member 32, is formed on one end of the shaft 37. The pinion 38 is coupled to the link 31. The link 31 includes a rack 39, which is engaged with the pinion 38, an engagement pin 40, which is fitted in the rack 39, and an urging member 41, which is arranged between the rack 39 and the engagement pin 40. The urging member 41 may be a coil spring. The engagement pin 40 includes a projection 42 that is fitted into an elongated hole 43 of the rack 39 (refer to FIGS. 4 and 6) to couple the rack 39 and the engagement pin 40. The lock motor 33 produces drive force that rotates the rotation member 32 about the axis L1 of the cylindrical shaft 37. Rotation of the rotation member 32 moves the link 31 between a first position and a second position. At the first position, the link 31 fixes the lock pin 26 at a lock position in a direction (Y axis direction in FIG. 3) orthogonal to the longitudinal direction of the lock pin 26. At the second position, the link 31 permits movement of the lock pin 26 to an unlock position.

Figure 4A:
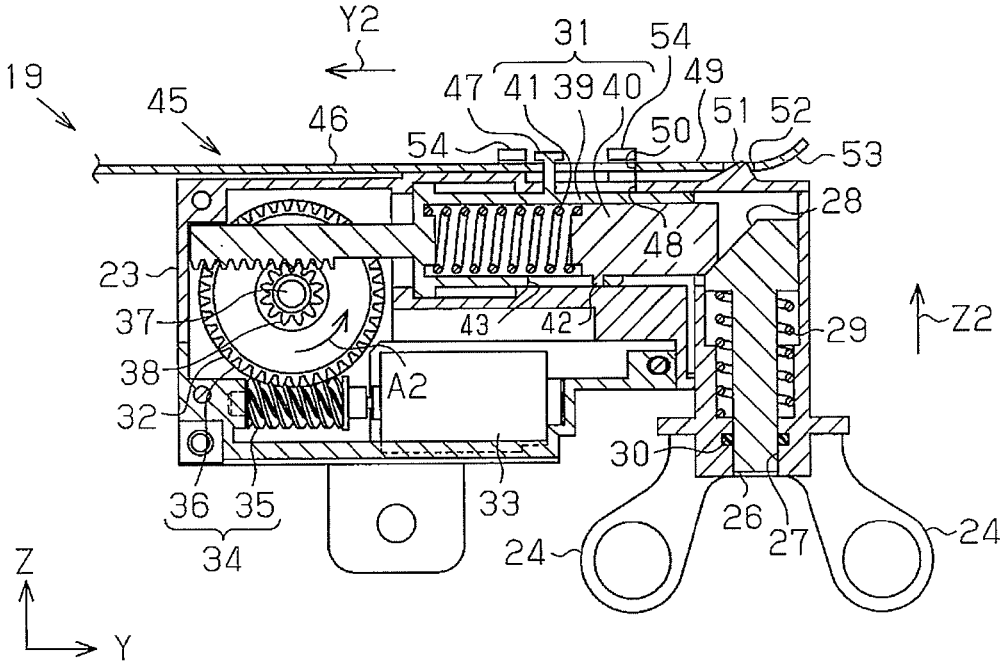
FIG. 4A is a cross-sectional view and FIG. 4B is a perspective view showing the lock device in an unlock state.
Figure 4B:
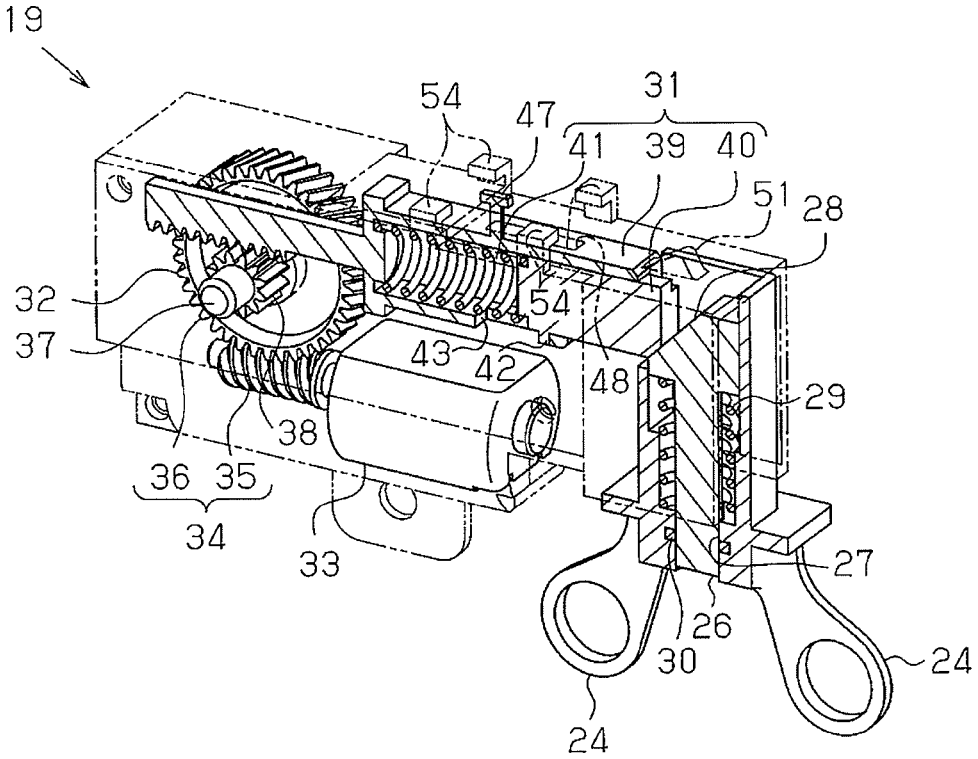

Referring to FIGS. 4A and 4B, when conditions for initiating unlocking are satisfied, the lock motor 33 produces rotation in one direction to rotate the rotation member 32 in an unlock direction (direction of arrow A2 in FIG. 4A). This moves the link 31 in an unlock direction (direction of arrow Y2 in FIG. 4A) from the first position to the second position and separates the engagement pin 40 from the upper surface of the lock pin 26. When the engagement pin 40 is separated from the upper surface of the lock pin 26, the urging member 29 lifts the lock pin 26 in an unlock direction (direction of arrow Z2 in FIG. 4A). This moves the lock pin 26 to the uppermost position, that is, the unlock position.

Figure 5A:
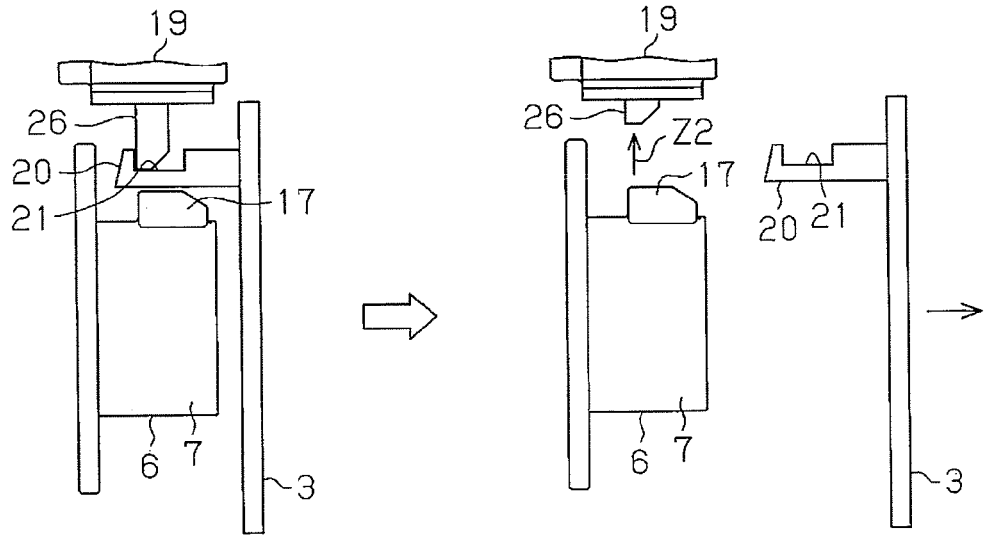
FIG. 5A is a schematic diagram showing the lid when unlocked.
Figure 5B:
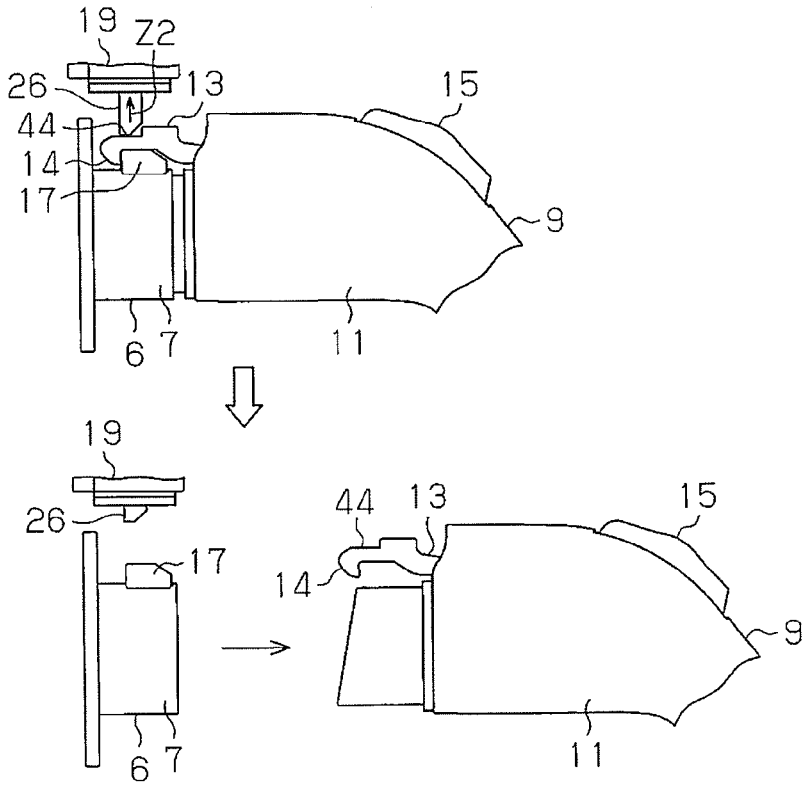
FIG. 5B is a schematic diagram showing the charge cable when unlocked.

Referring to FIG. 5A, if the lock pin 26 is located at the unlock position when the lid 3 is closed, the lock pin 26 is separated from the engagement groove 21 of the striker 20. This unlocks the lid 3. Thus, opening of the lid 3 is permitted so that the user can manually open the lid 3. Referring to FIG. 5B, if the lock pin 26 is located at the unlock position when the charge cable 9 is fitted to the inlet 6, the lock pin 26 is separated from an abutment surface 44 defined by the upper surface of the hook 14. This unlocks the charge cable 9. Thus, the lock arm 13 may be pivoted to an open position to remove the charge cable 9 from the inlet 6.

Figure 6A:
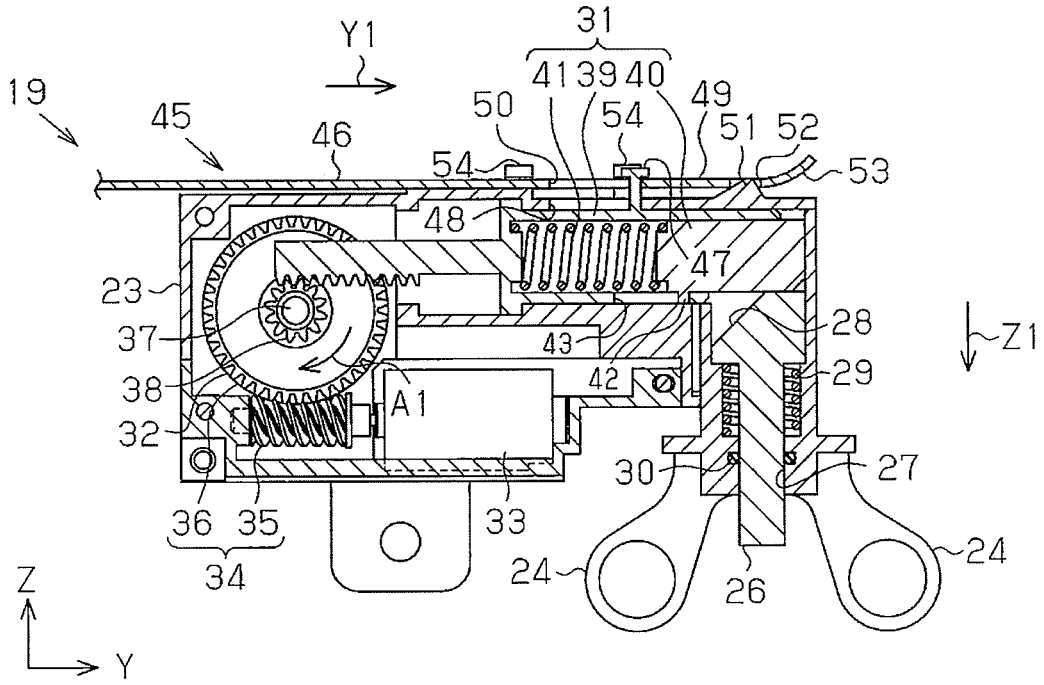
FIG. 6A is a cross-sectional view and FIG. 6B is a perspective view showing the lock device in a lock state.
Figure 6B:
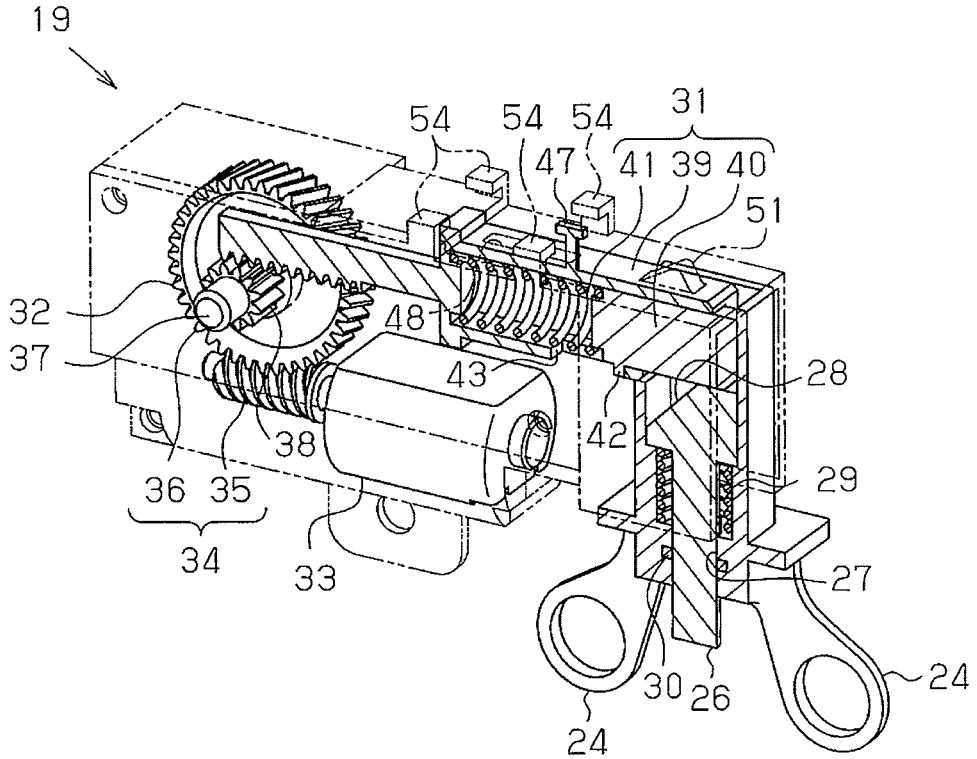

Referring to FIGS. 6A and 6B, when conditions for initiating locking are satisfied, the lock motor 33 produces rotation in the other direction to rotate the rotation member 32 in a lock direction (direction of arrow A1 in FIG. 6A). This moves the link 31 in a lock direction (direction of arrow Y1 in FIG. 6A) from the second position to the first position so that the engagement pin 40 pushes the pushing slope 28 of the lock pin 26 and lowers the lock pin 26 in a lock direction (direction of arrow Z1 in FIG. 6A). When the engagement pin 40 is fitted into the space above the upper surface of the lock pin 26, the lock pin 26 is located at the lowermost position, that is, the lock position.

Figure 7A:
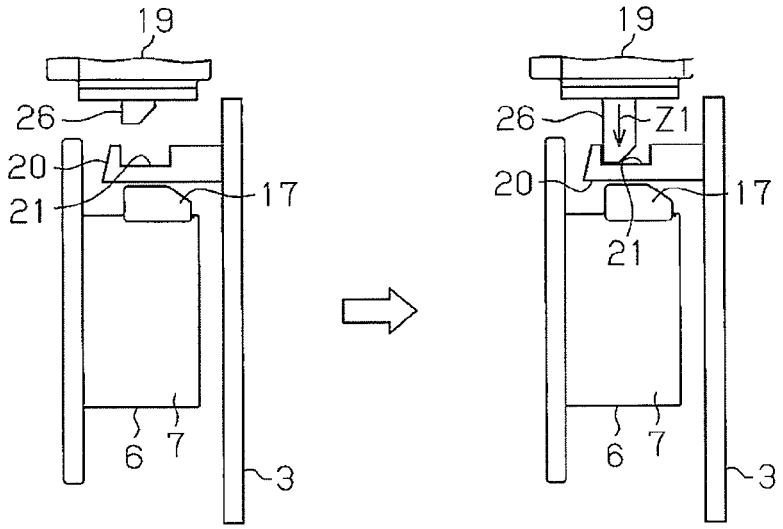
FIG. 7A is a schematic diagram showing the lid when locked.
Figure 7B:
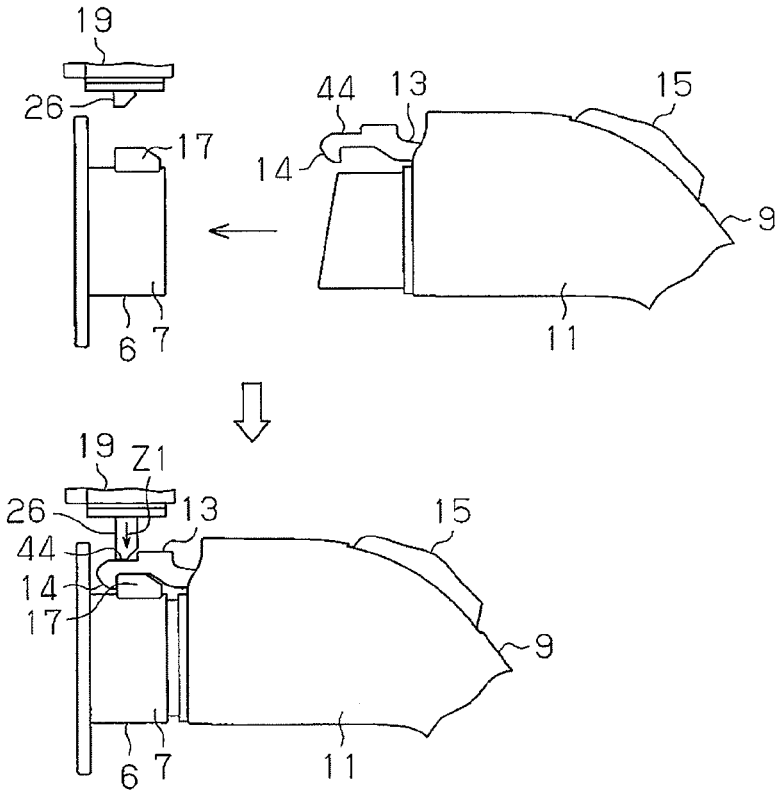
FIG. 7B is a schematic diagram showing the charge cable when locked.

Referring to FIG. 7A, if the lock pin 26 is located at the lock position after the lid 3 is closed, the lock pin 26 is engaged with the engagement groove 21 of the striker 20. This locks the lid 3. Thus, an unauthorized person cannot open the closed lid 3. Referring to FIG. 7B, when the lock pin 26 is located at the lock position after the charge cable 9 is fitted to the inlet 6, the lock pin 26 is in contact with the abutment surface 44 of the hook 14. This locks the charge cable 9. Thus, an unauthorized person cannot remove the power plug 11 from the inlet 6.

Forcible Unlocking Mechanism

Figure 8:
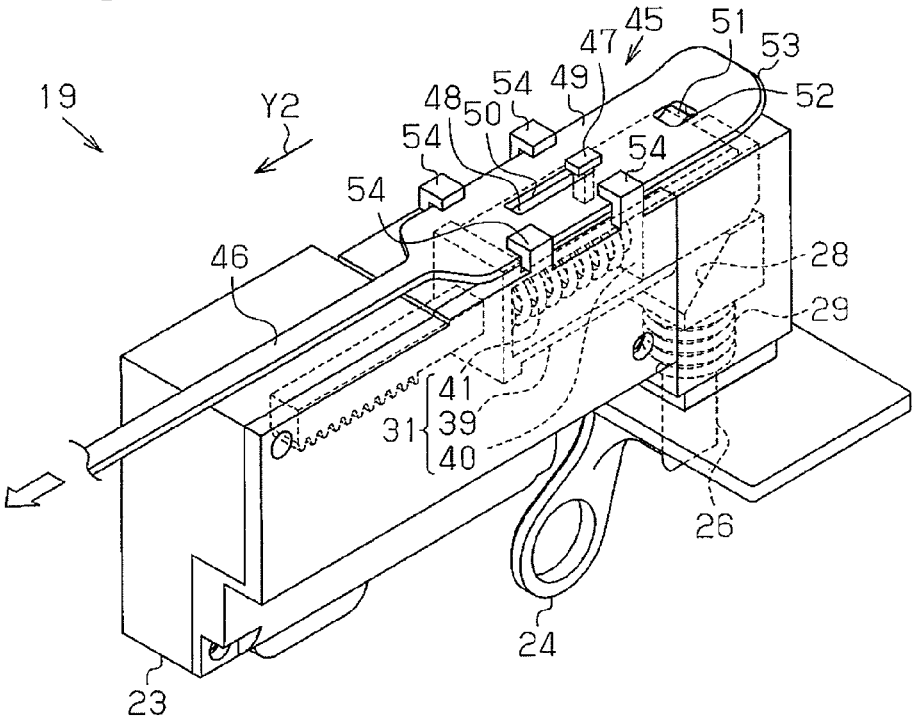
FIG. 8 is a perspective view showing a forcible unlocking mechanism in a normal lock state.
Figure 9:
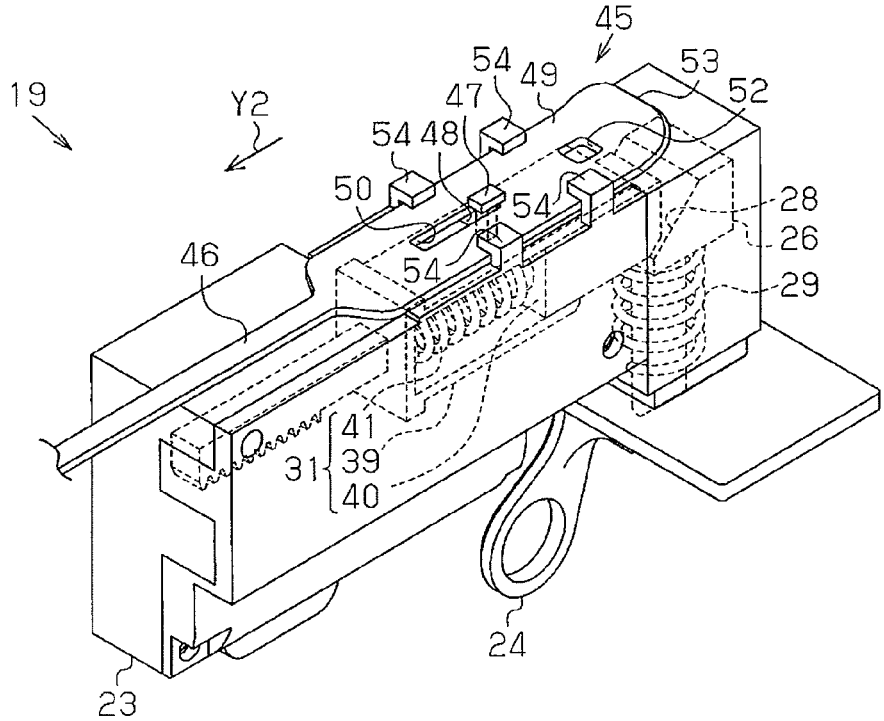
FIG. 9 is a perspective view showing the forcible unlocking mechanism when performing forcible unlocking.

Referring to FIGS. 8 and 9, the lock device 19 includes a forcible unlocking mechanism 45 that allows for forcible manual cancellation of a lock state of the lock device 19. For example, if the lock motor 33 or a peripheral circuit of the lock motor 33 fails to function normally when the lock device 19 is in a lock state, the forcible unlocking mechanism 45 allows for manual forcible cancellation of the lock state of the lock device 19.

In the present example, a forcible unlocking wire 46, which is operated when forcibly cancelling the lock state of the lock device 19, is coupled to an end of the link 31. The forcible unlocking wire 46 includes a flat portion 49, which is arranged at one end of the forcible unlocking wire 46, an elongated hole 50, which extends through the central section of the flat portion 49, and a hooking hole 52, which extends through the distal end of the flat portion 49. One end of the forcible unlocking wire 46 is arranged in the vehicle (e.g., luggage compartment). The forcible unlocking wire 46 is pulled in, for example, the luggage compartment toward the direction of arrow Y2 in FIG. 8 from a normal position (FIG. 8) to a cancellation position (FIG. 9) to forcibly cancel the lock state of the lock device 19. The forcible unlocking wire 46 corresponds to a forcible unlocking member.

The forcible unlocking mechanism 45 includes a wire holding structure that holds the forcible unlocking wire 46 in a fixed state when the lock device 19 performs normal locking and unlocking operations. A claw-shaped projection 47 projects from an upper surface of the rack 39. An opening 48 is formed in the upper surface of the housing 23. Further, the housing 23 includes a position holding projection 51, which projects from the upper surface at a location closer to the end than the opening 48, and two pairs of guide pieces 54, which project from the upper surface at two opposite sides. The two guide pieces 54 guide the movement of the forcible unlocking wire 46. The position holding projection 51 has, for example, a triangular cross-section. The claw-shaped projection 47 is engaged with the forcible unlocking wire 46 and exposed from the housing 23. The claw-shaped projection 47 is extended out of the opening 48 and engaged with the elongated hole 50 of the forcible unlocking wire 46. During a normal locking or unlocking operation, the claw-shaped projection 47 moves in the elongated hole 50 and does not affect the forcible unlocking wire 46. The claw-shaped projection 47, the opening 48, and the elongated hole 50 form a holding unit.

The position holding projection 51 is hooked to the hooking hole 52 of the forcible unlocking wire 46. The distal end of the flat portion 49 is bent to form a returning guide 53. The position holding projection 51 and the hooking hole 52 form an aiding unit.

The operation of the forcible unlocking mechanism 45 will now be described with reference to FIGS. 4, 6, 10, and 11.

Operation of Forcible Unlocking Mechanism During Normal Locking and Unlocking

Referring to FIGS. 4 and 6, when the lock device 19 is performs a normal locking or unlocking operation, the link member 31 is moved in the locking or unlock direction (Y axis direction in FIGS. 4 and 6) between the first position and the second position in accordance with the locking or unlocking operation. In such a case, the claw-shaped projection 47 moves in the elongated hole 50 and does not interfere with the forcible unlocking wire 46. Thus, the forcible unlocking wire 46 is held at a normal position. In this manner, the link member 31 is not moved by the link 31 during normal locking and unlocking operations. This reduces the load on the lock motor 33.

Forcible Unlocking Operation

Figure 10:
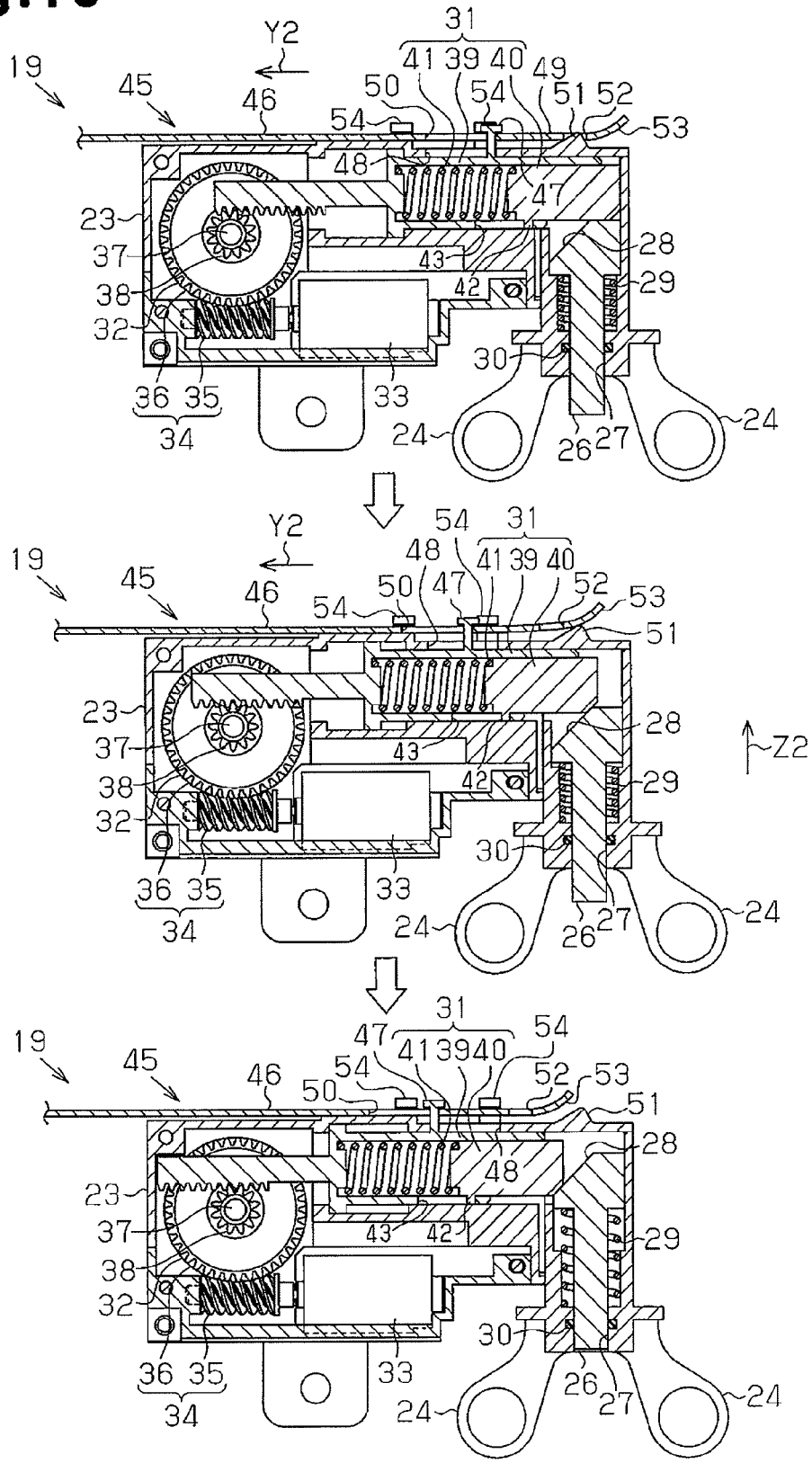
FIG. 10 is a schematic diagram showing forcible unlocking procedures.

FIG. 10 shows the procedures taken to perform forcible unlocking by pulling the forcible unlocking wire 46. For example, if the lock motor 33 or a peripheral circuit of the lock motor 33 fails to function when the lock device 19 is in a lock state, the link 31 cannot be moved to the second position at the unlock side with the lock motor 33, and the lock device 19 cannot be returned to the unlock state. In this case, the forcible unlocking wire 46 may be pulled in the luggage compartment to forcibly switch the lock device 19 to an unlock state.

When the forcible unlocking wire 46 is pulled in the direction of arrow Y2 in FIG. 10 to the cancellation position, the claw-shaped projection 47 pulls an edge of the elongated hole 50 toward the unlock side to move the link 31 in the unlock direction (direction of arrow Y2 in FIG. 10) to move the link 31 from the second position to the first position. When pulling the forcible unlocking wire 46, the position holding projection 51 is separated from the hooking hole 52. When the engagement pin 40 is separated from the upper portion lock pin 26, the lock pin 26 becomes movable. Thus, the urging force of the urging member 29 moves the lock pin 26 in the unlock direction (direction of arrow Z2 in FIG. 10). When the lock pin 26 reaches the unlock position, the lock device 19 is switched to an unlock state.

Figure 11:
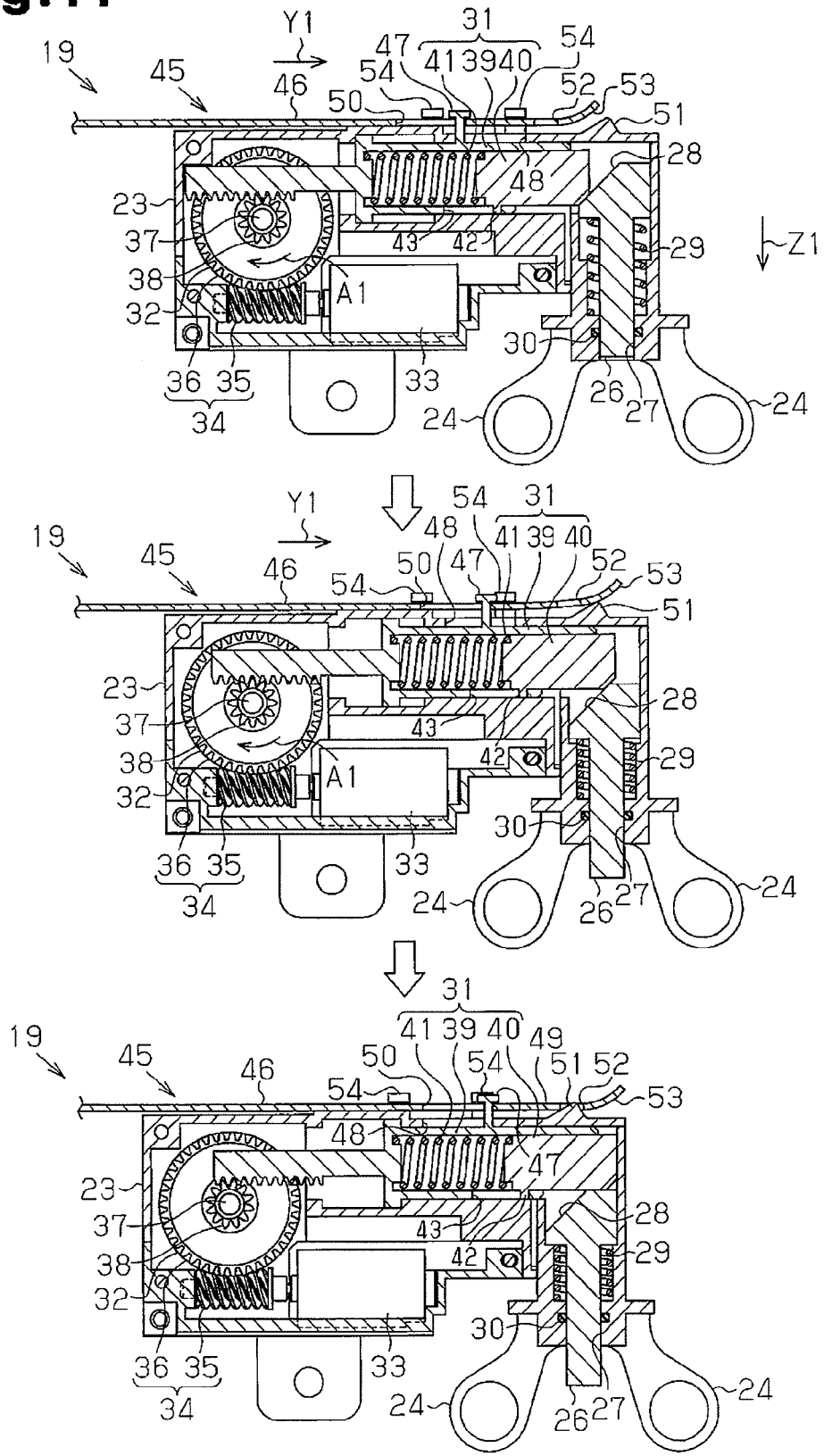
FIG. 11 is a schematic diagram showing the procedures taken when returning to an original initial position after forcible unlocking is performed.

FIG. 11 shows the procedures taken after performing forcible unlocking to return the lock device 19 to the original normal position. After performing forcible unlocking, for example, the lock device 19 may be repaired by replacing the lock motor 33 with a new one. In this case, when the lock motor 33 produces rotation in the lock direction, the rotation member 32 rotates in the unlock direction (direction of arrow A1 in FIG. 11). The claw-shaped projection 47 pulls an edge of the elongated hole 50. This integrally moves the link 31 and the forcible unlocking wire 46 in the lock direction (direction of arrow Y1 in FIG. 11).

When the link 31 moves in the lock direction (direction or arrow Y1 in FIG. 11) to the first position, the link 31 pushes the pushing slope 28 of the lock pin 26. This moves the lock pin in the lock direction (direction of arrow Z1 in FIG. 11), that is, in a direction that intersects the moving direction of the link at approximately ninety degrees. When the engagement pin 40 moves onto the upper portion of the lock pin 26, the lock pin 26 is located at the lock position, and the lock device 19 is switched to a lock state. When the link 31 is moved to the lock position, the returning guide 53 guides the position holding projection 51 on the wire end. When the forcible unlocking wire 46 reaches the initial position, the position holding projection 51 is hooked again to the hooking hole 52.

The present embodiment has the advantages described below.

(1) The lock device includes the forcible unlocking mechanism that forcibly unlocks the charge cable when a user moves a lock stopper from the initial position to the cancellation position with a wire or the like.

For example, when a wire is merely connected to the lock stopper, a normal locking or unlocking operation of the lock device may also move the wire in cooperation with the lock stopper. Such movement of the wire may deteriorate the wire or produce noise.

In contrast, the present invention includes the wire holding mechanism that holds the forcible unlocking wire 46 on the housing 23 so that the forcible unlocking wire 46 is not moved during a normal locking or unlocking operation. Thus, even when the link 31 (rack 39) moves back and forth during a normal locking or unlocking operation, the forcible unlocking wire 46 does not move from the initial position. In this manner, during a normal locking or unlocking operation, the forcible unlocking wire 46 is not moved by the rack 39.

(2) The forcible unlocking wire 46 is not moved during a normal locking or unlocking operation. This reduces the load on the lock motor 33 during a normal locking or unlocking operation and lowers the torque required for the lock motor 33.

(3) The wire holding mechanism includes the claw-shaped projection 47, which projects from the upper surface of the rack 39, the opening 48, which extends through the upper wall of the housing 23, and the elongated hole 50, which extends through the forcible unlocking wire 46. Thus, the wire holding mechanism has a simple structure formed by projections and holes.

(4) The position holding projection 51 is hooked to the hooking hole 52 of the forcible unlocking wire 46 to hold the forcible unlocking wire 46 at the initial position. This holds the forcible unlocking wire 46 at the initial position. Thus, the forcible unlocking wire 46 subtly moves from the initial position even when the driven vehicle generates vibrations.

(5) After performing forcible unlocking with the forcible unlocking mechanism 45, for example, the lock motor 33 may be repaired. Then, by performing a normal locking operation with the lock motor 33, the rack 39 may be moved from the second position to the first position to move the forcible unlocking wire 46 in the same direction and return the forcible unlocking wire 46 to the original position. Thus, the pulled forcible unlocking wire 46 may be returned to the original initial position.

(6) The distal end of the flat portion 49 includes the returning guide 53 that extends upward from the upper surface of the housing 23. Thus, when the forcible unlocking wire 46 returns to the initial position, the forcible unlocking wire 46 easily moves over the position holding projection 51. This allows for the forcible unlocking wire 46 to smoothly return to the original initial position.

(7) The same lock pin 26, which is moved between lock and unlock positions by the lock motor 33, is used for charge cable locking and lid locking. Thus, there is no need to provide separate lock pins and lock motors for the charge cable locking and lid locking. This allows for the structure of the lock device 19 to be simplified.

It should be apparent to those skilled in the art that the present invention may be embodied in many other specific forms without departing from the spirit or scope of the invention. Particularly, it should be understood that the present invention may be embodied in the following forms.

Figure 12:
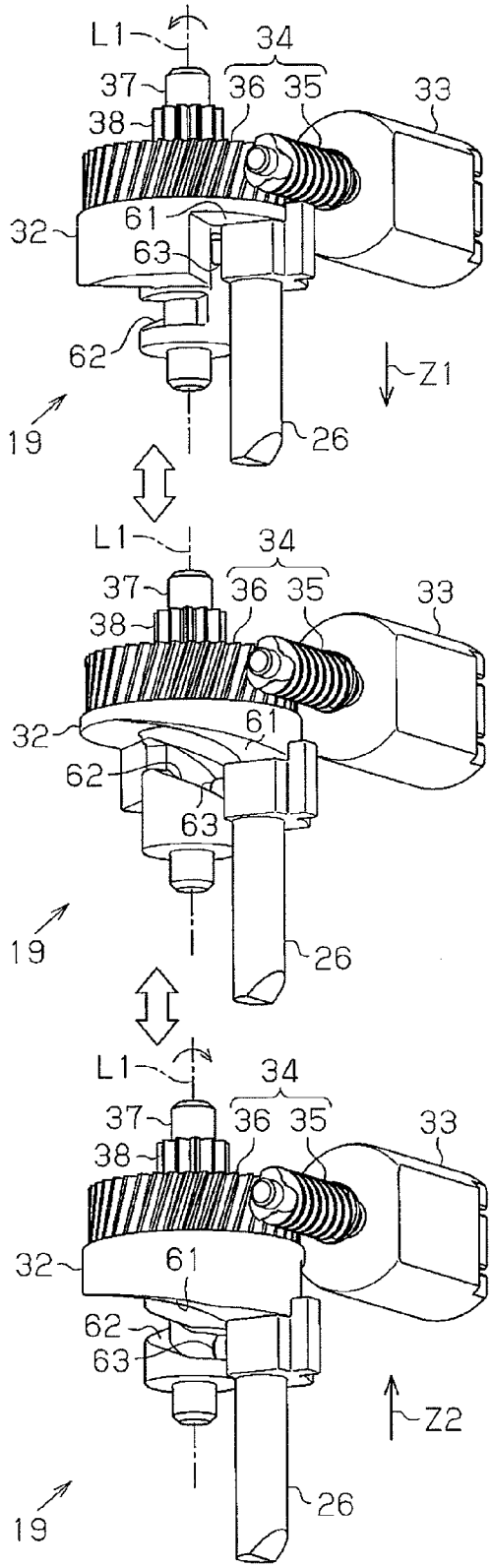
FIG. 12 is a schematic diagram showing a lock device of a further example switched between a lock state and an unlock state.

The lock device 19 does not have to be of a sliding type and may be of a rotating type as shown in FIG. 12. When the lock device 19 is of a rotating type, two guide surfaces, namely, a lock guide surface 61 and an unlock guide surface 62, which have different heights, are arranged on the shaft 37 of the rotation member 32 at a radially inward location and a radially outward location. When the rotation member 32 rotates in the lock direction, the lock guide surface 61 pushes the upper end of the lock pin 26 downward and moves the lock pin 26 in the lock direction to the lock position. When the rotation member 32 rotates in the unlock direction, the unlock guide surface 62 lifts an engagement pin 63 of the lock pin 26 and moves the lock pin 26 in the unlock direction.

Figure 13A:
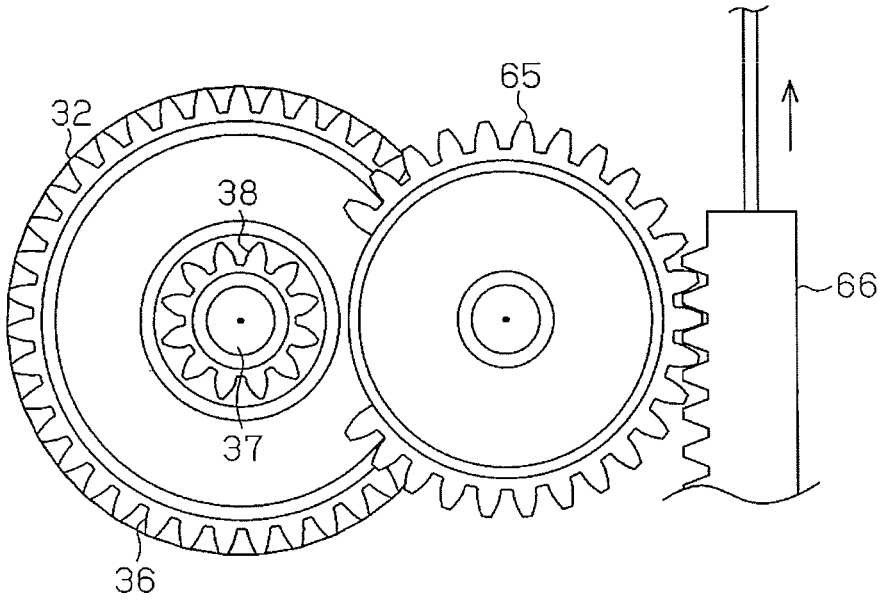
FIG. 13A is a schematic diagram showing a forcible unlocking mechanism in another example.
Figure 13B:
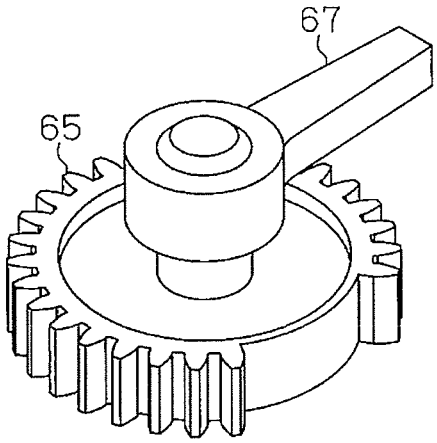
FIG. 13B is a perspective view showing a lever of the forcible unlocking mechanism.

Referring to FIG. 13A, the forcible unlocking mechanism 45 of the present example may be applied to the rotating type lock device 19. In this case, a partially toothless pinion 65 is coupled to a rack 66. During a normal locking or unlocking operation, the pinion 65 is not engaged with the pinion 38. Thus, the rotation of the rotation member 32 rotates the pinion 38 but not the pinion 38. When performing forcible unlocking, the rack 66 is manually pulled in the direction of the arrow in FIG. 13A. This rotates the pinion 65. After a while, the pinion 65 is engaged with the pinion 38. This rotates the rotation member 32 to the unlock side. In this structure, as shown in FIG. 13B, a lever 67 may be used to rotate the pinion 65 and facilitate forcible unlocking.

The aiding unit may be replaced by an urging member such as a spring. In this case, when the urging member produces a relatively large urging force, after pulling the forcible unlocking wire 46, the forcible unlocking wire 46 is returned from the unlock position to the lock position. Thus, the urging force of the urging member is set to be smaller than the force required to move the forcible unlocking wire 46 from the unlock position to the lock position.

The claw-shaped projection 47 may be arranged on the forcible unlocking wire 46, and the elongated hole 50 may be arranged in the rack 39.

The claw-shaped projection 47 may be arranged on, for example, the engagement pin 40.

As long as the transmission member may be manually moved in the unlock direction, the forcible unlocking mechanism 45 may have any of a variety of structures.

The forcible unlocking member may be replaced by, for example, a knob, a lever, or a dial.

The forcible unlocking wire 46 may be arranged on a side surface or rear surface of the housing 23.

The opening 48 does not have to be an elongated hole and may be a void having a wide opening.

The engaging portion does not have to be claw-shaped and may have any shape as long as it may be hooked to the forcible unlocking wire 46.

The electronic key system may be, for example, a wireless key system or a short-range wireless communication system. A wireless key system performs key verification through narrow-band wireless communication when communication is established with an electronic key. A short-range wireless communication system performs verification through bidirectional short-range wireless communication (communication distance of several centimeters to several tens of centimeters) and may be, for example, an immobilizer system or a near field communication (NFC) system.

The actuator of the lock device 19 may be, for example, a solenoid instead of a motor.

The plug connection detector 18 may be a switch or a sensor arranged in the inlet 6. Further, the plug connection detector 18 may include or not include a contact.

The seal 30 may be arranged on the lock pin 26.

The lid 3 may be opened and closed by a push lifter instead of a torsion spring.

During lid locking, the lock pin 26 may be engaged with a component other than the striker 20.

The lock device 19 does not have to be arranged in the upper portion of the lid box 5 and may be arranged at other locations such as a side portion of the lid box 5.

The lock device 19 may be fastened together with the inlet 6 when coupled to the lid box 5 or coupled to the lid box 5 separately from the inlet 6.

The lock device 19 may be switched to an unlock state by pushing, for example, a trigger switch 22.

The lock device 19 may be manually switched to a lock state or an unlock state by a user.

One of locking and unlocking with the lock device 19 may be performed manually, and the other one of locking and unlocking may be performed automatically.

The lock device 19 may be dedicated for charge cable locking or for lid locking. Further, in broad terms, the lock device 19 only needs to be arranged in the power port 2.

The locking subject does not have to be the lid 3 or the charge cable 9 and may be any component related with the power port 2 of a battery-powered vehicle.

The lock device 19 may have any structure as long as the lock pin 26 may be moved in the lock direction and the unlock direction. Further, the lock member does not have to be a movable pin and may be, for example, a pivotal cylindrical pin member including a cutout portion. In this case, the lock arm 13 is fixed by a location free from the cutout portion, and the cutout portion allows for operation of the lock arm 13. The lock member may be a triangular plate pivoted between a lock position and an unlock position.

In the lock device 19, an urging member may constantly urge the lock pin 26 in an unlock direction or a lock direction.

The lock device 19 may be of a direct-connection type in which, for example, a projection and a sloped groove couples the lock pin 26 to a support, and the movement of the support guides the lock pin 26 with the projection and the sloped groove to the lock position and the unlock position.

The lock device 19 may directly engage the lock pin 26 with the housing (main body) of the power plug 11.

The lock device 19 does not have to be installed in a vehicle and may be applied to a different device or apparatus.

The present examples and embodiments are to be considered as illustrative and not restrictive, and the invention is not to be limited to the details given herein, but may be modified within the scope and equivalence of the appended claims.

The invention claimed is:

1. A lock device comprising:

a lock member moved between a lock position, at which the lock member restricts removal of a locking subject from a power port, and an unlock position, at which the lock member permits removal of the locking subject from the power port;

a transmission member moved between a first position, at which the transmission member fixes the lock member at the lock position, and a second position, at which the transmission member permits movement of the lock member to the unlock position; and a forcible unlocking mechanism including a movable forcible unlocking member that manually moves the transmission member to the second position, and a holding unit that holds the forcible unlocking member while permitting movement of the transmission member between the first position and the second position.

2. The lock device according to claim 1, wherein the forcible unlocking member includes an engaging portion arranged on the transmission member, and an engaged portion arranged on the forcible unlocking member, wherein the engaged portion is engaged with the engaging portion of the transmission member while permitting movement of the transmission member between the first position and the second position.

3. The lock device according to claim 2, wherein the engaging portion of the forcible unlocking member includes a claw-shaped projection, and the engaged portion of the forcible unlocking member includes an opening engaged with the claw-shaped projection.

4. The lock device according to claim 2, wherein the engaging portion of the forcible unlocking member includes an opening, and the engaged portion of the forcible unlocking member includes a claw-shaped projection engaged with the opening.

5. The lock device according to claim 1, wherein the forcible unlocking member moves between an initial position, which corresponds to the first position of the transmission member, and a cancellation position, at which the forcible unlocking member forcible moves the transmission member to the second position, and the lock device further comprises an aiding member that aids movement of the forcible unlocking member to the initial position.

6. The lock device according to claim 5, wherein after the transmission member is forcibly moved to the second position, the transmission member is returned from the second position to the first position, and the forcible unlocking member is moved to the initial position.

7. The lock device according to claim 1, further comprising a housing that accommodates the lock member and the transmission member, wherein the housing includes an upper surface to which the forcible unlocking mechanism is coupled, the aiding member includes a position holding projection arranged on the upper surface of the housing, wherein the position holding projection is engageable with the holding unit, and the forcible unlocking member includes a returning guide arranged on a distal end of the holding unit, wherein the returning guide extends upward from the upper surface of the housing.

* * * * *